United States Patent [19]

Dominick et al.

[11] 3,966,116

[45] June 29, 1976

[54] SECURITY BOX AND RECEPTACLE HOUSING FOR VALUABLES

[75] Inventors: George G. Dominick, Hoffman Estates; Ronald J. Lugowski, Rolling Meadows; Phillip D. Goodrich, Hoffman Estates; Kenneth Erickson, Palatine, all of Ill.

[73] Assignee: Qonaar Corporation, Elk Grove Village, Ill.

[22] Filed: Apr. 12, 1974

[21] Appl. No.: 460,276

[52] U.S. Cl. ..... 232/7; 232/16

[51] Int. Cl.[2] ..... G07B 15/00

[58] Field of Search ..... 232/7, 16, 15, 11

[56] References Cited

UNITED STATES PATENTS

| | | | |
|---|---|---|---|
| 162,420 | 4/1875 | Robinson | 232/7 |
| 333,233 | 12/1885 | Landgrone | 232/63 |
| 467,146 | 1/1892 | Beasley | 232/16 |
| 912,776 | 2/1909 | Baker | 232/15 |
| 917,256 | 4/1909 | Cox | 232/15 |
| 1,186,579 | 6/1916 | Jacob | 232/15 |
| 1,450,028 | 3/1923 | Epstein | 232/15 |
| 1,534,163 | 4/1925 | Cox | 232/7 |
| 2,815,166 | 12/1957 | Sollenberger | 232/16 |
| 2,835,439 | 5/1958 | Care | 232/7 |
| 3,670,955 | 6/1972 | Dominick et al. | 232/7 |

*Primary Examiner*—James T. McCall

*Attorney, Agent, or Firm*—McDougall, Hersh & Scott

[57] ABSTRACT

A construction for securing valuables such as currency wherein the currency is deposited in a housing which removably holds a storage box for the valuables. The storage box is provided with a door which is normally locked in the closed position but which is unlocked and movable to an open position when associated with the housing. Movement of the door between open and closed positions is controlled by a pivotally mounted arm which is freed for movement when the storage box is located in the housing. The arm is controlled by a handle exposed on the exterior of the storage box, and the locking means provided determine the capability of handle movement. A separate acceptance receptable is provided for the discharge of valuables from the storage box into the receptacle. The operation of a separate storage box door is controlled by drive mechanisms associated with the acceptance receptacle, and the locking means of the storage box also determine the capability of movement of the drive means.

11 Claims, 24 Drawing Figures

4
42
3
20
4
24
21
27
3a
60
60
68
5
72
33b
62
5
78
74
146
80
86
113
6
111
112
97
104
106
96'
99
100
101
94
96
102
108
98
92
22
84a
6
118
87
116
132
48
134
164
46
36
164a
120
48a
136
168
122
164b
138
48b
166
166b
172
50
170
126
116
128
44
171
3a
40
3
38

SECURITY BOX AND RECEPTACLE HOUSING FOR VALUABLES

This invention relates to a security system for the handling of valuables such as coins, bills, tokens and other valuables which are desirably deposited in means which provide for safe-keeping of the valuables.

The safe-keeping of valuables is of increasing concern. There is, for example, great concern regarding the protection of currency and tokens which are collected in the course of transit operations and other public transportation systems. Furthermore, the protection of valuables which are collected in the course of the sale of goods or the dispensing of services is of significant concern.

Wherever valuables are collected, various problems arise. For example, in the case of large transit systems, fares are collected on many individual vehicles or at many different stations. In many instances, the collection systems require handling of the fares by the operator of the vehicle or by an attendant at a station. The fares are handled, for example, during transfer of the monies collected to coin changers or money bags.

Additional handling is required when delivering fares to a central collection point. Such handling takes time, and there are also other time-consuming tasks which lead to expense such as the counting and recording of amounts collected.

Aside from the inefficiencies which characterize money collection systems, security problems are prevalent. Pilferage on the part of persons handling valuables is common in spite of a variety of measures which have been developed for preventing such pilfering.

Robbery also consituted a serious problem in any system requiring the collection of valuables. A bus driver or gas station attendant, for example, is extremely vulnerable to robbery since a robber can take coin changers and money bags within a very short time. Drivers and attendants are particularly vulnearable at night when it is virtually impossible to provide sufficient police for preventing such occurrences.

In order to overcome the problems referred to, "exact" collection systems have been developed. In the case of transit systems, riders are required to have exact change which is deposited in a vault-like construction so that the monies will be secure within the vault and so that the driver or other attendant will not handle any money. Such vault arrangements are also used in other instances, such as at service stations, so that attendants do not need to handle money and are, therefore, not subject to robbery.

As explained in Dominick, et al. U.S. Pat. No. 3,670,955, even systems utilizing more secure housings for valuables can be subject to pilferage or robbery. The system described in this patent provides a uniquely suitable arrangement for overcoming even the deficiencies of prior systems.

Specifically, the patented arrangement employs a housing designed for receiving and holding fares whereby visual inspection of the fares is provided. The fares are then transferred to a removable cash box which is itself a highly secure mechanism. Accordingly, when the cash box is removed, tampering is minimized so that the contents can be readily transferred to a vault. The vault structure is accomodated to the cash box to provide a highly secure arrangement for insuring safe passage into the vault.

It is a general object of this invention to provide an improved construction for receiving and holding valuables whereby the valuables are handled on a highly efficient basis.

It is a more specific object of this invention to provide an improved receiver housing for valuables and an improved removable cash box structure for the housing.

It is a still further object of this invention to provide an improved cash box structure and an improved vault structure for accepting valuables from the cash box.

These and other objects of this invention will appear hereinafter and for purposes of illustration, but not of limitation, specific embodiments of the invention are shown in the accompanying drawings in which.

Figure 5A:
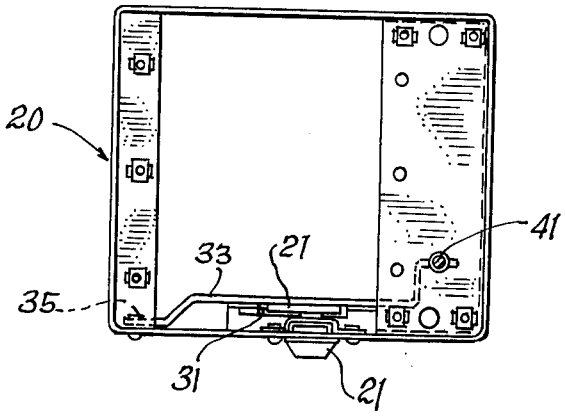
Figure 5B:
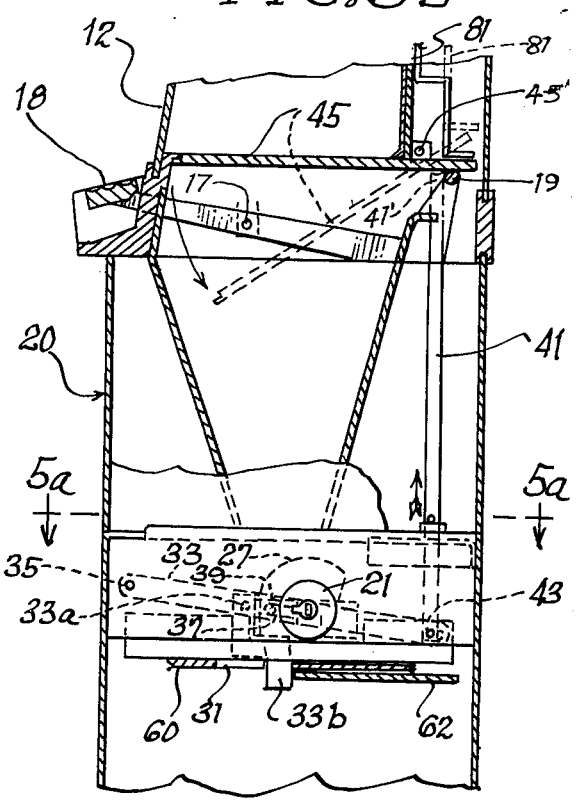
Figure 2:
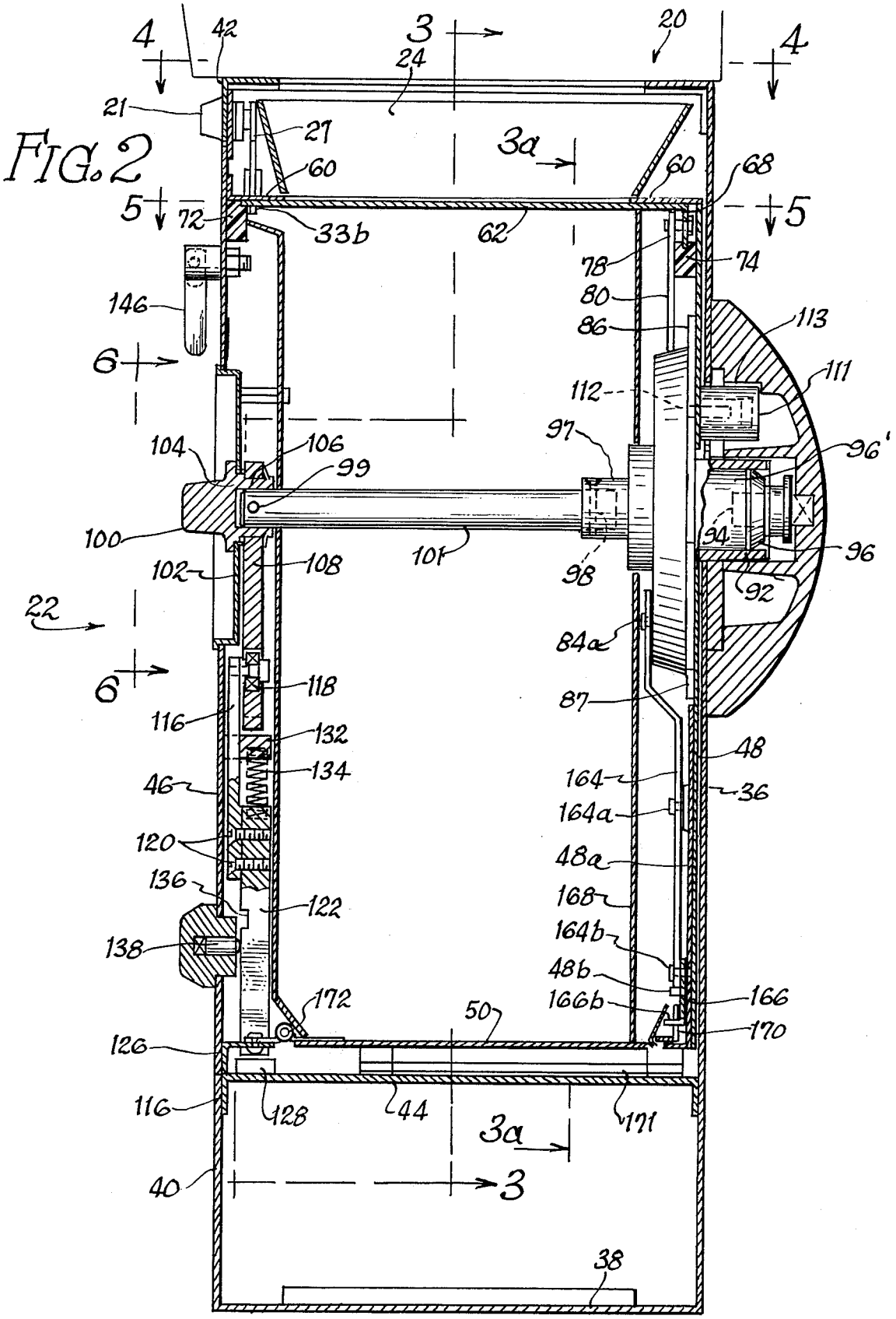
FIG. 2 is a vertical sectional view of the cash box structure and associated lower housing parts.
Figure 3:
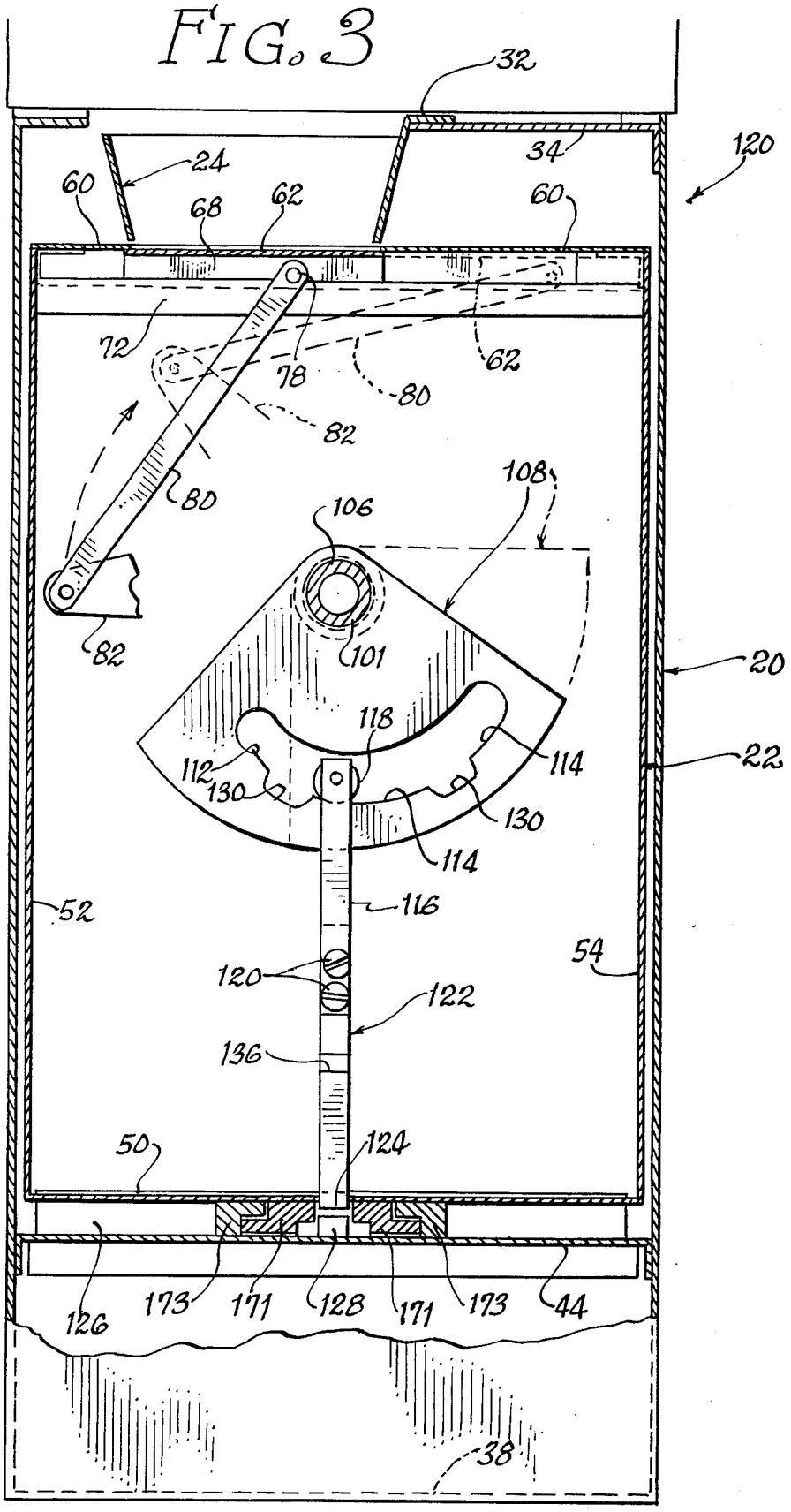
FIG. 3 is a vertical sectional view taken about the line 3—3 of FIG. 2.
Figure 3A:
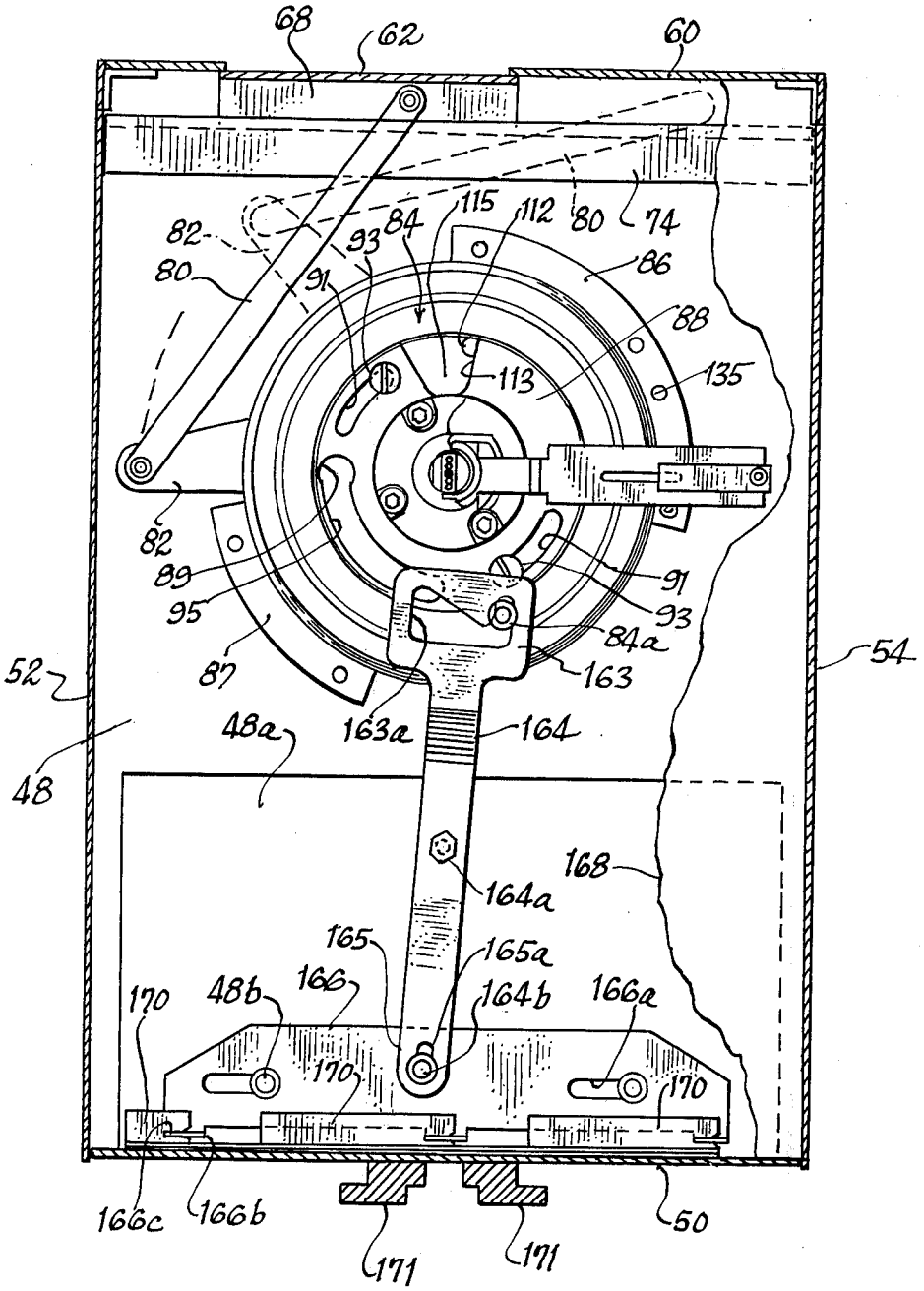
Figure 4:
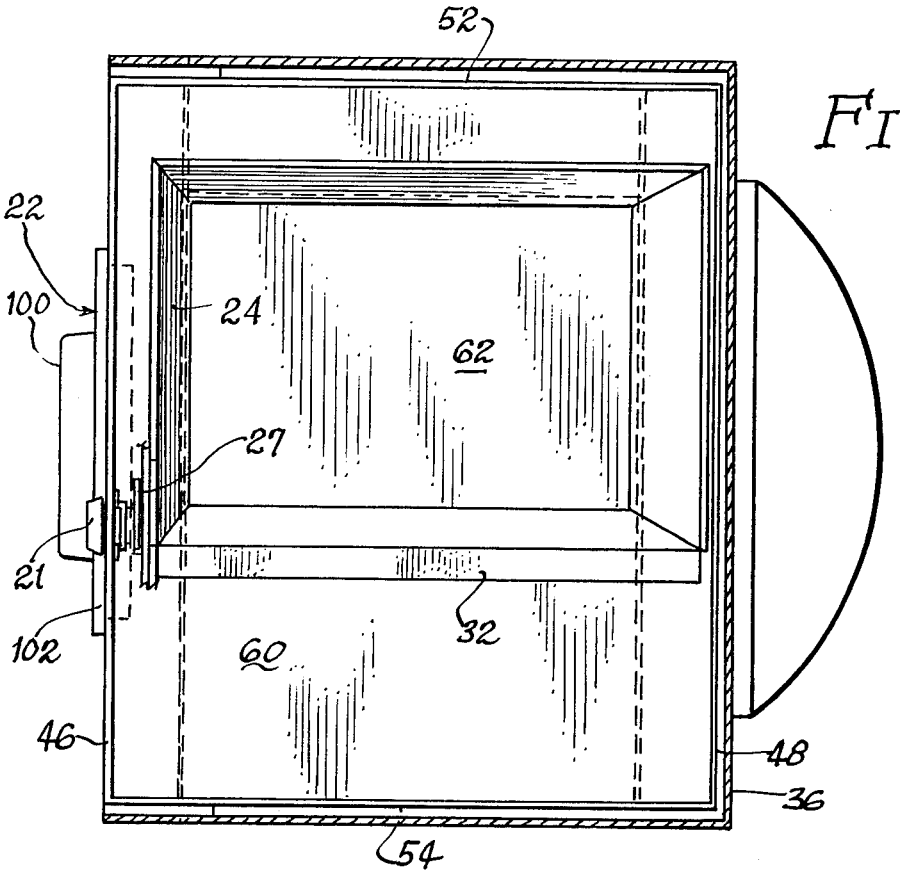
Figure 5:
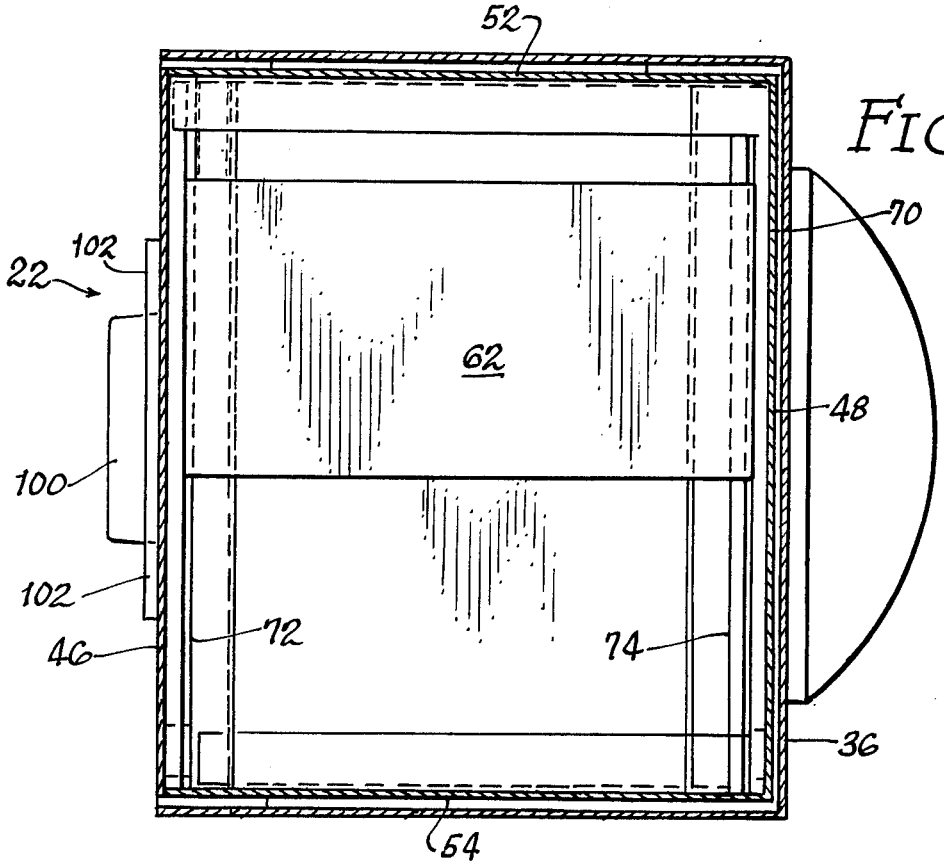

FIG. 3*a* is a vertical sectional view taken about the line 3*a*—3*a* of FIG. 2 illustrating only the cash box in section;

FIG. 4 is a plan view taken about the line 4—4 of FIG. 2;

FIG. 5 is a cross-sectional view taken about the line 5—5 of FIG. 2;

FIG. 5*a* is a horizontal sectional view illustrating an auxiliary locking mechanism for the construction;

FIG. 5*b* is a fragmentary elevational view illustrating the structure shown in FIG. 5*a;*

Figure 6:
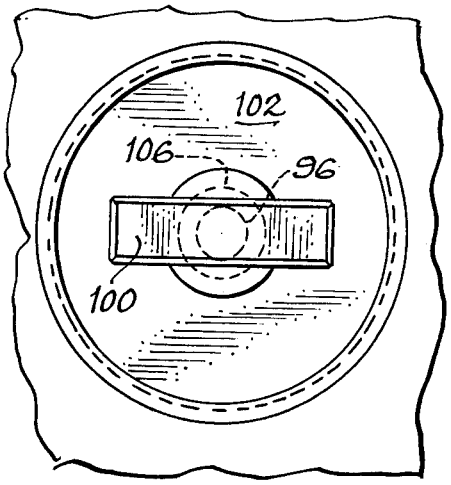
Figure 7:
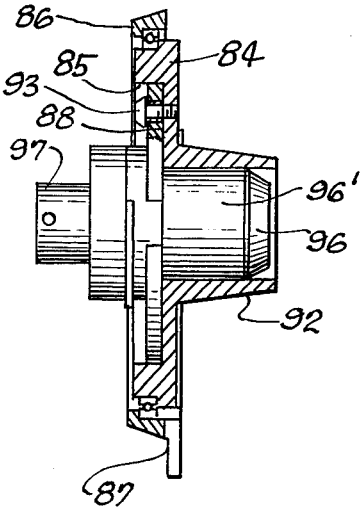
Figure 8:
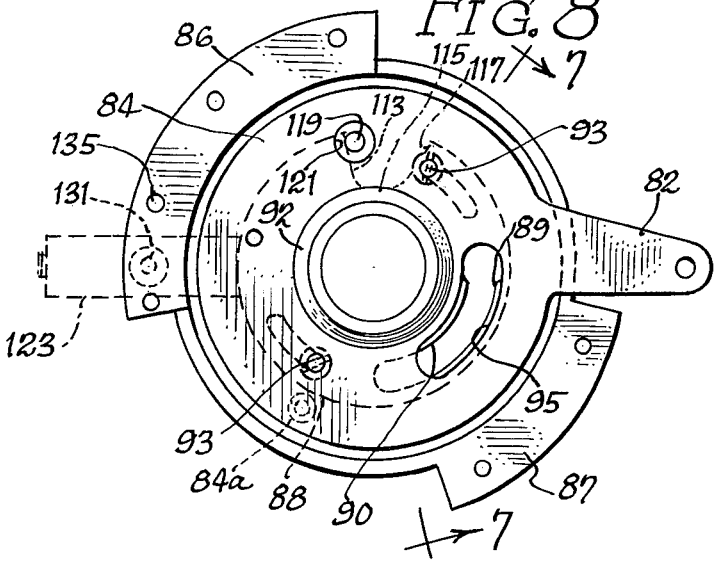
Figure 8A:
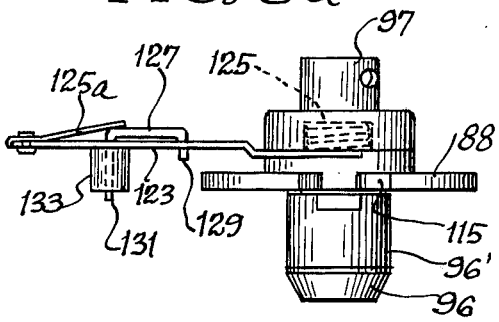
Figure 8B:
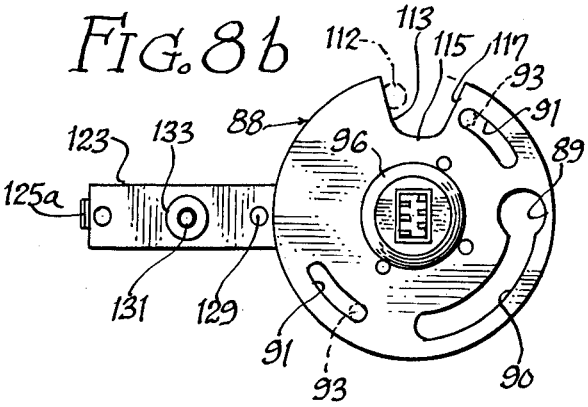

FIG. 6 is a fragmentary view of the cash box operating handle structure taken about the line 6—6 of FIG. 2;

FIG. 7 is a cross-sectional view illustrating the cash box locking elements taken about the line 7—7 of FIG. 8;

FIG. 8 is an elevational view of the locking elements shown in FIG. 7;

FIG. 8*a* is a top elevation of the locking element structure including a safety locking arm shown in FIG. 8;

FIG. 8*b* is an elevational view of a portion of the structure shown in FIG. 8*a;*

Figure 8C:
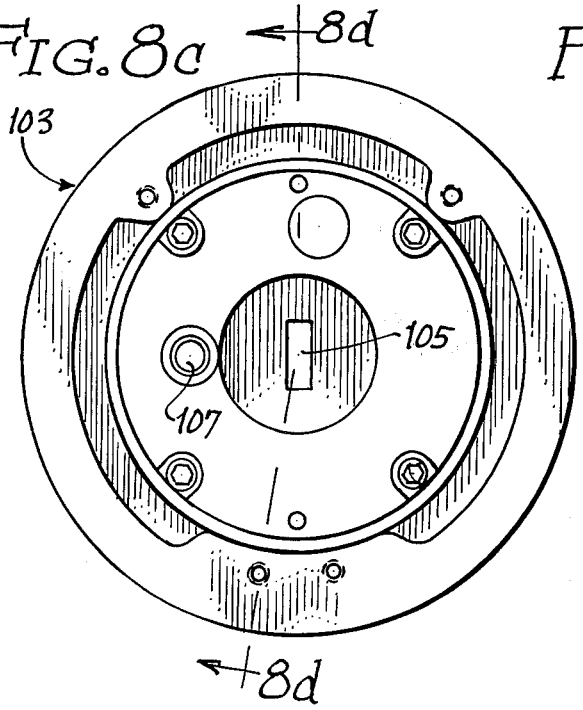
Figure 8D:
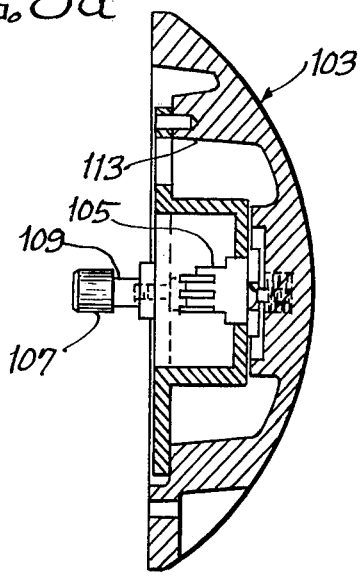

FIG. 8*c* is a front elevation of the key and pin members associated with the operational means of the cash box;

FIG. 8*d* is a cross-sectional view taken about the line 8*d*—8*c;*

Figure 8E:
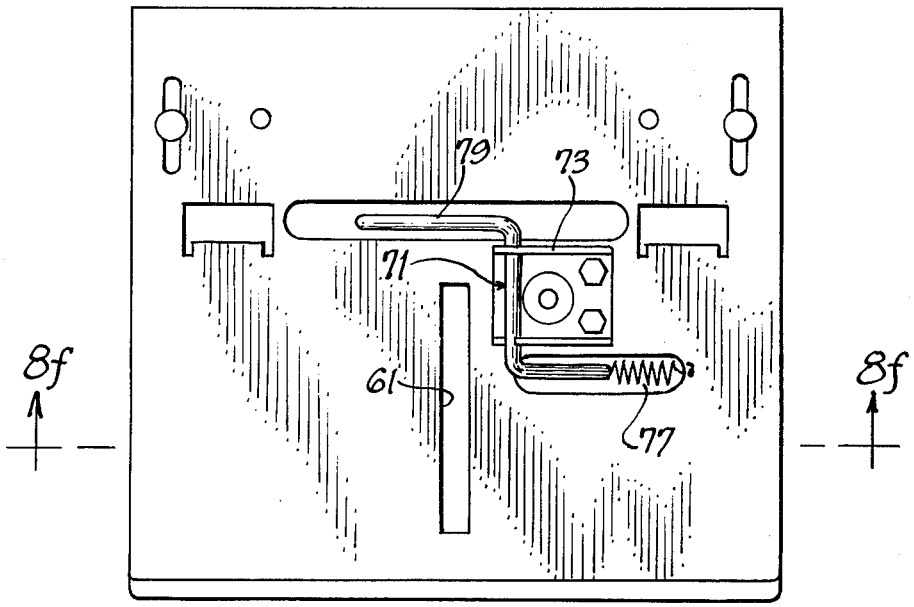
Figure 8F:
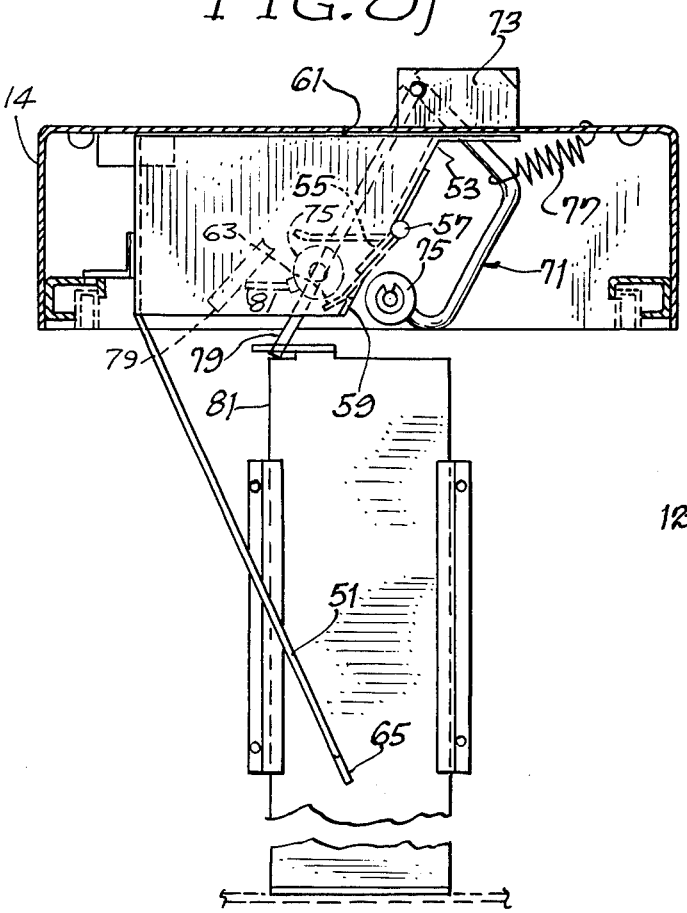

FIG. 8*e* is a plan view of a coin tray control means utilized in the construction;

FIG. 8*f* is a cross-sectional view taken about the line 8*f*—8*f* of FIG. 8*e;*

Figure 8G:
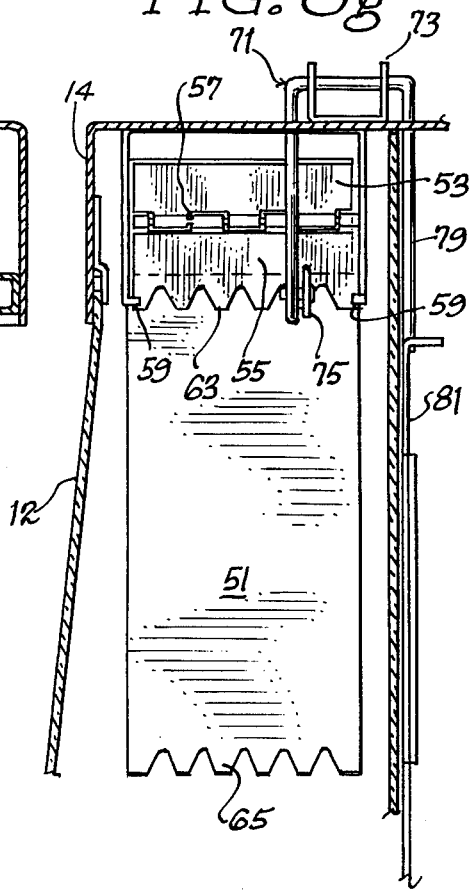

FIG. 8*g* is an elevational view of the structure shown in FIG. 8*f;*

Figure 11:
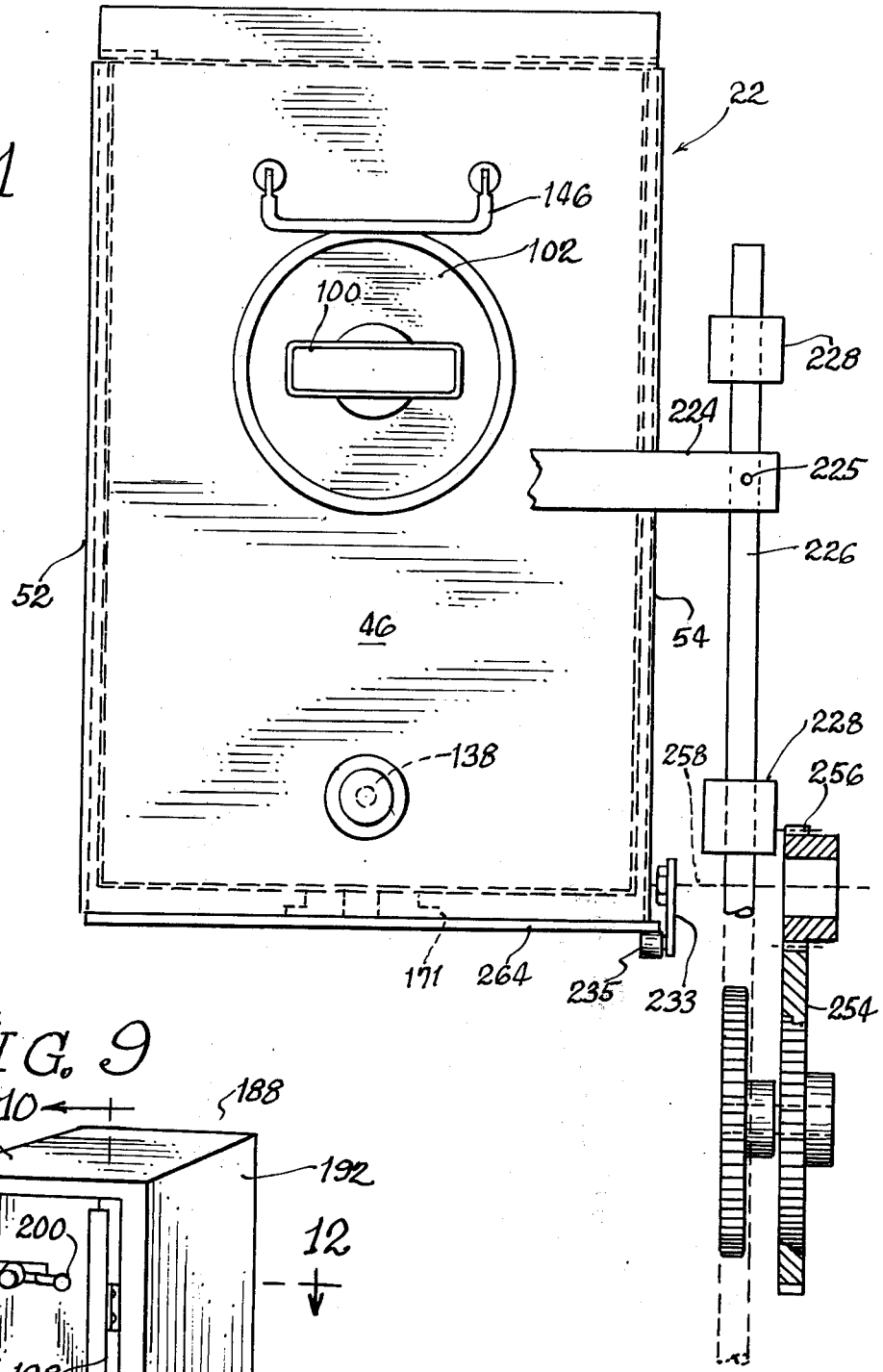
Figure 9:
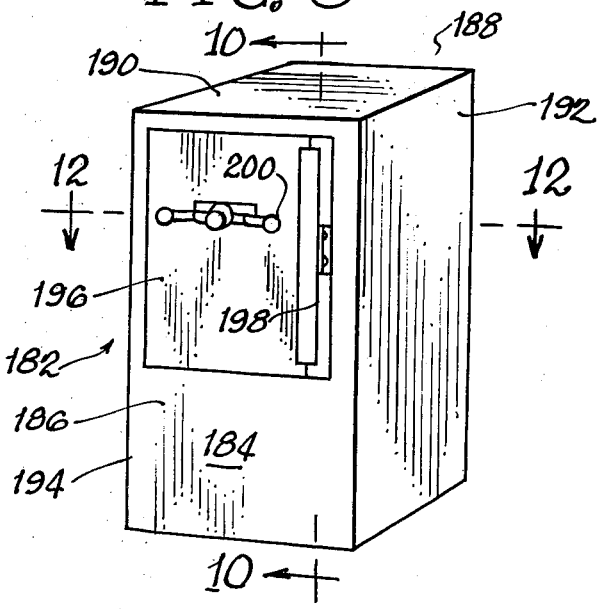
Figure 10:
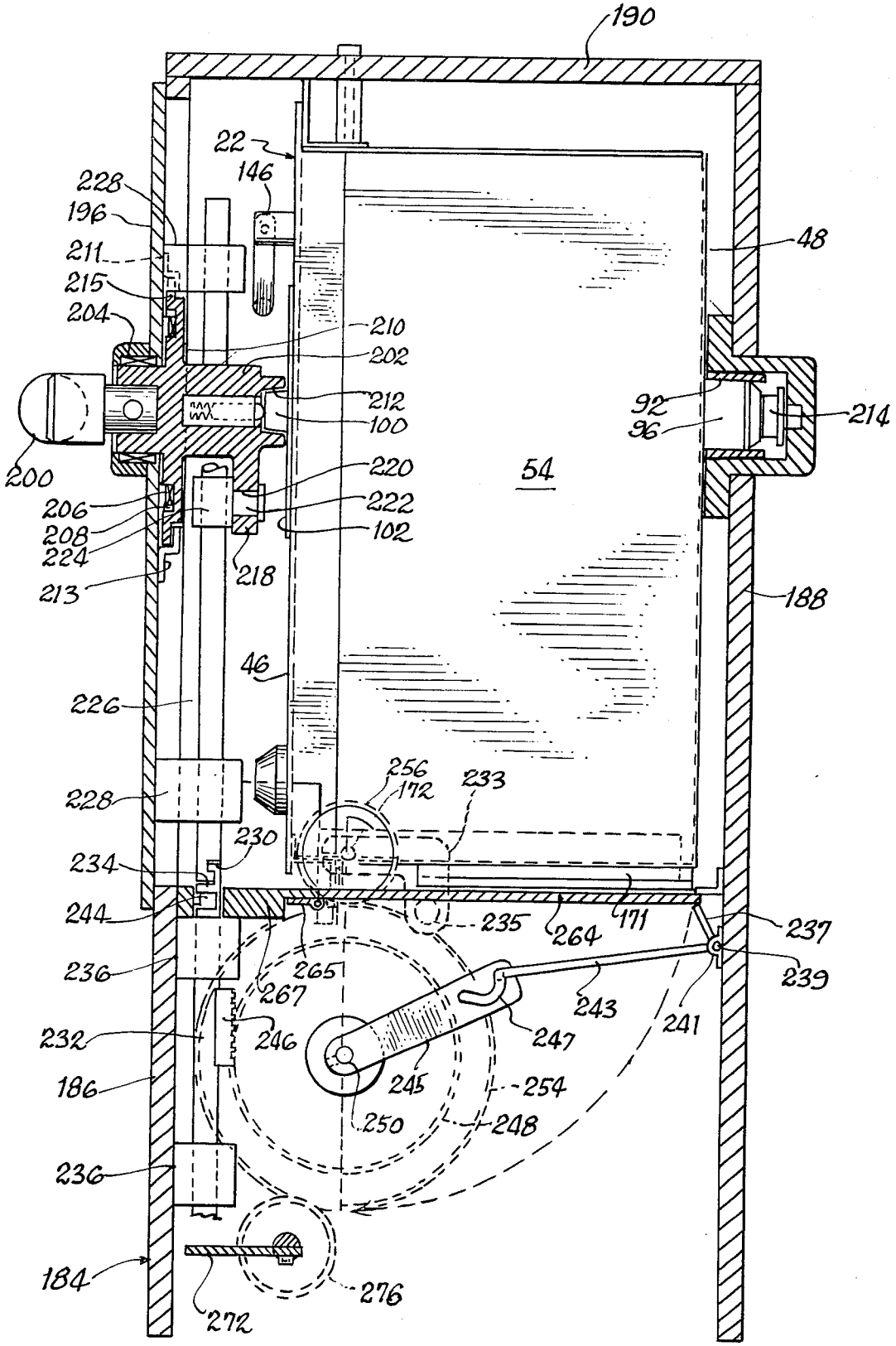
Figure 12:
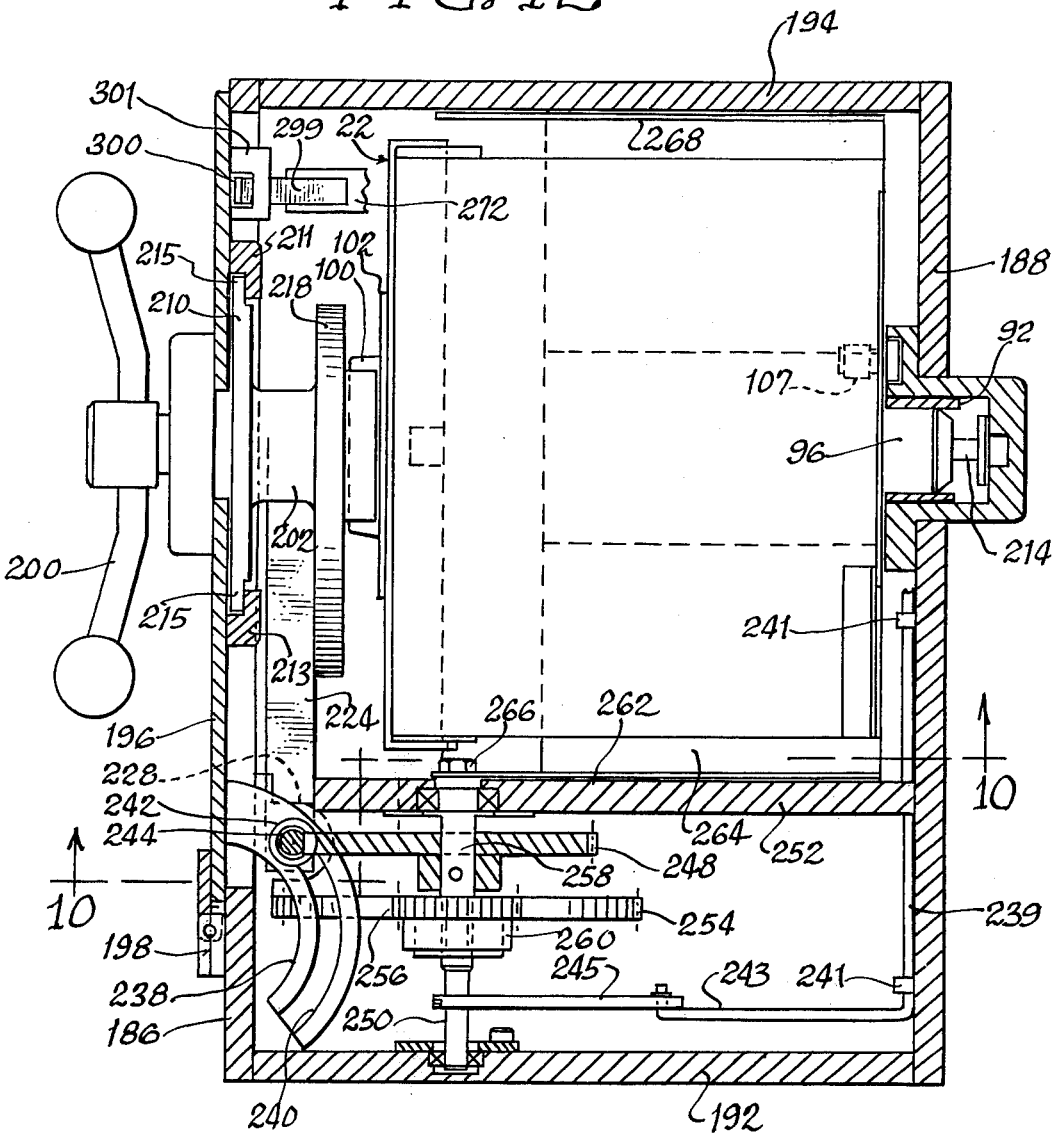
Figure 14:
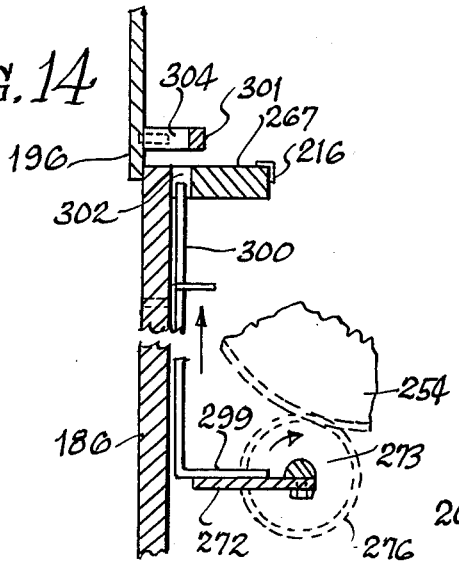
Figure 13:
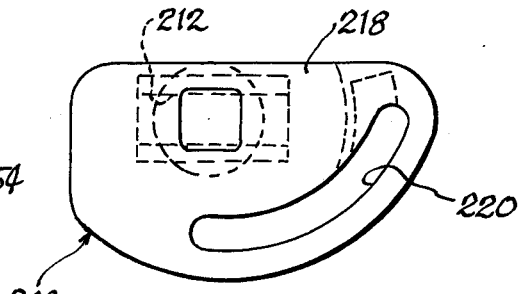

FIG. 9 is a perspective view of a vault structure designed for accepting valuables from a cash box;

FIG. 10 is a vertical sectional view of the vault structure with associated cash box taken about the line 10—10 of FIG. 9;

FIG. 11 is a fragmentary front elevation illustrating the cash box in position relative to associated acceptance receptacle parts;

FIG. 12 is a horizontal sectional view taken about the line 12—12 of FIG. 9;

FIG. 13 is a detailed view of a cam plate mechanism employed for opening the cash box when mounted within the acceptance receptacle; and, FIG. 14 is a fragmentary sectional view illustrating portions of the door lock mechanism.

This invention relates to a construction for receiving valuables wherein a housing is provided for the deposit of the valuables. The housing defines a recess for removably receiving a cash box or other structure employed for holding the valuables deposited. The cash box is of the type including a door which normally closes access to the box and which includes a lock for maintaining the closed position. The housing defines means for unlocking the door when the box is properly locked in a housing recess to that the box can be opened for receiving valuables deposited.

The above arrangement which generally characterizes an arrangement of the type described in the aforementioned Dominick, et al. patent, is provided with certain improved features in accordance with this invention. Specifically, the cash box design of this invention comprises a door which is connected to a pivotally mounted arm. The arm is connected to the lock so that the arm is free for movement only upon unlocking of the lock. A handle mounted on the outside of the box is connected to the arm, and rotation of the handle operates to pivot the arm to move the door to an unblocking position.

The box for receiving valuables defines a rectangular cross section so that maximum utilization of the space can be accomplished. The box is designed with an operating handle which is exposed when the box is received by the housing and a separate housing door is not required with the construction of the invention. A plurality of interlock features are provided so that the box cannot be opened outside the housing and so that the box must be in proper relationship with the housing before transfer of valuables into the box can be accomplished.

The box design is uniquely suited to an acceptance receptacle or vault which is employed in the over-all system. The acceptance receptacle includes an area for receiving the box which permits the opening of a completely separate box door. This door permits passage of valuables into the acceptance receptacle interior upon operation of mechanisms designed for opening the box. Interlock features are again employed to prevent improper box operation.

Figure 1:
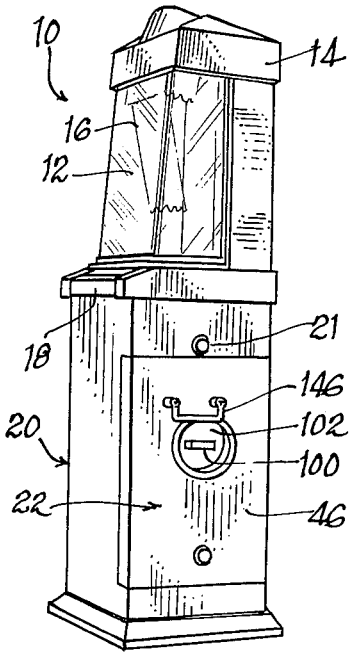
FIG. 1 is a perspective view of a fare box housing incorporating features of the invention.

In the accompanying drawings, FIG. 1 illustrates a fare box 10 of the type suited for use in conjunction with the features of this invention. As explained in the aforementioned Dominick, et al. patent, the fare box is preferably provided with a window 12 so that the vehicle operator or other attendant can visually inspect deposits made in the box. These deposits are inserted through an opening in the top section 14 of the housing, and they are passed through a chute 16 until coming to rest on an inspection surface defined by the plate 45. A trip bar 18 is pivotally mounted at 17 and is provided with end 19 engaging the bottom of plate 45. With this bar the attendant can remove fares deposited from the inspection surface by pushing down on the bar after seeing that the proper fare was inserted.

The construction includes a lower section 20 defining a recess for receiving a cash box 22. As will be more fully explained, this cash box is removably received by the fare box construction so that the contents of the cash box can be removed with the cash box and then transferred to a main deposit area.

FIGS. 2 through 8*g* illustrate the cash box 22 in association with the lower section of the housing as well as the components thereof. As shown in FIGS. 2 and 3, this lower section includes a receiving area for the valuables which are passed from the upper section of the fare box. This receiving area comprises a cup or funnel 24 suspended by means of flange 32 extending over a horizontally extending wall portion 34 and fasteners (not shown) are associated with this flange for maintaining the funnel in position.

The housing defines a rear wall 36, a bottom wall 38 and front wall portions 40 and 42. An intermediate horizontally extending wall portion 44 is positioned in spaced relationship with the bottom wall 38. The area extending between the funnel 24 and the intermediate wall 44 defines an area for receiving the cash box 22.

The cash box 22 defines a front wall 46, a rear wall 48, a bottom wall 50, side walls 52 and 54, and a top wall 60. The wall 60 defines a rectangular central opening communicating with the passage defined by the funnel 24.

A door 62 is adapted to be positioned as shown in FIGS. 2 and 3 whereby access to the interior of the cash box is closed. The door 62 is provided with a turned-down flange 68 and a nylon guide 74 is secured to the rear wall 48 to provide a lower bearing surface for this flange. A track 72 secured to front wall 46 defines a shoulder for engagement with the opposite edge of the door. The respective blocks 72 and 74 and the wall 60 thus define a guide track for the door 62.

The flange 68 of door 62 has secured thereto the end 78 of a link 80. The link 80 is connected at its opposite end to lever arm 82. Movement of the lever arm in the direction of the arrows shown in FIGS. 3 and 3*a* operates to move the door 62 from the closed position illustrated to the open position shown in dotted lines (FIG. 3). The movement of the door is controlled by the track defined by the members 72 and 74.

FIGS. 5*a* and 5*b* illustrate an auxiliary locking arrangement for the construction providing anti-pilfering features. This arrangement utilizes the lock 21 located on the front wall of the lower section 20. A latch element 27 is connected to the lock plug. A pivot pin 33*a* mounted on lever 33 is connected to an offset slidable tongue 33*b* adapted to be received within a slot 31 defined by the top wall 60 of the cash box. It will be appreciated that when the tongue 33*b* is in the position shown in FIG. 5*b*, the cash box is retained against removal from the lower section 20 of the fare box housing. The tongue 33*b* also moves into the path of movement of the door 62. Specifically, in the closed position, the door interferes with movement of the latch, but when the door is opened and the latch moved into the position of FIG. 5*b*, the latch then prevents return movement of the door. Accordingly, the door 62 cannot be closed until the latch is moved away from the position shown in FIG. 5*b*.

The lever 33 is pivotally connected at 35 to the housing, and this lever defines a slot 37 which receives another pin 39 carried by the latch 27. Accordingly, when the latch is pivoted clockwise away from the position shown in FIG. 5*b*, the lever 33 is pivoted upwardly. A rod 41 is connected at 43 to the end of the lever, and this rod extends into engagement 41′ with the inspection plate 45 of the cash box so that upward movement of the rod pivots the plate about its pivot point 45'. As explained in the aforementioned Dominick, et al. patent, pvioting of the inspection plate results in discharge of any money located on the plate into the cash box associated with the fare box.

With the latch in the position shown in FIG. 5*b*, the cash box cannot be removed from the housing and the door 62 is open. The lock 21 must be operated as a step prior to removal of the cash box so that any fares on the inspection plate must be dumped into the cash box before the door 62 is closed. This prevents anyone from leaving fares on the inspection plate until after removal of the cash box from the lower section of the housing. Similarly, the door 62 cannot be closed until the tongue 33*b* is moved so that fares on the inspection plate will always pass into the cash box before the door is closed.

The arm is located adjacent the rear wall of the construction. This arm is illustrated in FIGS. 3, 3*a* and 8, and as shown, this arm is formed integrally with a circular member 84. The member 84 defines a peripheral shoulder to provide a bearing housing with stationary flange members 86 and 87 whereby the member 84 is rotatable relative to the flange members. These members are secured to the cash box wall 48.

The member 84 defines a central pocket 85 which receives a drive plate 88, and this drive plate defines an elongated slot including an enlarged end portion 89 and a narrow body portion 90. A pair of smaller slots 91 receive screws and bushings 93 which are threaded into openings defined by the member 84. As shown in FIG. 8, the slot 95 defined by the member 84 is normally positioned in overlying relationship relative to the slot portions 89 and 90 defined by the drive plate 88.

The member 84 defines a cylindrical housing 92 which receives a lock comprising plug 96 and cylinder 96', the latter being attached to drive plate 88. The drive plate 88 also supports a connector member 97 which is attached by means of screw 98 to a shaft 101 (FIG. 2). This shaft is connected to the cash box handle 100.

As shown in FIGS. 8*c* and 8*d*, a key housing 103 is provided for supporting a key 105. In addition, a lock pin 107 is carried by this housing, this lock pin being positioned to enter openings defined by the slot 95 and enlarged end 89 when a cash box is inserted in the receiver housing 20.

Assuming that the key 105 is proper for the lock associated with the cash box, the key will free the drive plate 88 for rotation by the handle 100. Particularly as explained in the aforementioned Dominick, et al. patent, initial rotation of the drive plate will move the enlarged slot portion 89 away from the head of the lock pin and the narrow portion 90 of the slot will then receive the reduced diameter shank 109 of the pin. This arrangement prevents removal of the cash box once rotation has commenced.

Rotation of the drive plate causes relative movement of the slots 91 and the screws and bushings 93 until the latter engage the member 84 at which time the member is rotated. This, of course, results in opening of the cash box door 62 through the action of the arm 82.

The cash box housing also carries a lock pin chamber 111 holding spring loaded pin 112 (FIG. 2), this pin extending through opening 119 and being normally engaged with the edge 113 defined by recess 115 formed in the drive plate 88. The engagement of this pin with the edge 113 permits relative rotation between the plate 88 and member 84 in one direction only. The opposite edge 117 of the recess 115 is provided with a sloped edge, however, so that the pin will be driven into chamber 111 to permit continued rotation of the drive plate 88 in the direction required for opening of door 62. The lock chamber 111 is received in recess 113 defined by the housing 103.

A spring bracket assembly comprising arm 123 is attached to the lock plug through a rectangular opening in cylinder wall 123' with the spring 125 providing preset torque (FIGS. 8*a* and 8*b*). The arm carries a leaf spring 125*a*, and this leaf spring bears against the pin 127. One end 129 of this pin is received in an opening defined by the arm 123, and the other end 131 is received in a cylinder 133 carried by the arm. The end 131 is normally pressed inwardly into engagement with the flange 86 (FIG. 8). When the lock cylinder is released upon insertion of a cash box into a receptacle, the lock plug is held stationary by the key, and there is no relative movement between the arm 123 and the flange 86. If, however, one attempted to achieve rotation with the cash box outside the receptacle, for example by inserting and turning an improperly obtained key, turning of the key would move the lock plug and the arm 123 clockwise with respect to the showing of FIG. 8. In this case, the end 131 of pin 127 would reach the opening 135 defined by the flange 86 and snap into this opening thereby locking the system against any further relative movement. This arrangement thus serves as an additional safety feature against improper use of the cash box.

In accordance with the concepts of this invention, the connecting member 88 is tied to shaft 101 by means of a pin 98. This shaft is in turn tied to the handle 100 by means of screw 99, the handle being exposed on the exterior of the cash box. The handle is received within a dish-shaped member 102 which is secured to the front wall 46 of the cash box. The handle extension 104 is circular and is positioned within a circular hole in member 102 whereby rotation of the handle relative to the dish-shaped member is possible.

A further handle extension 106 provides for mounting of plate 108. This plate defines a slot including a narrow first portion 112 and two relatively wider portions 114. An arm 116 carries a roller 118 which is movable within the slot portions. The arm 116 is connected by means of screws 120 to a locking bar 122. The bar 122 is received within an opening defined by the angle member 126 secured at the bottom edge of front wall 46. This angle member serves as a support for the door 50 by means of hinges 172.

In the position of the plate 108 shown in FIGS. 2 and 3, the bar 122 extends through the member 126 and is positioned adjacent block 122 mounted on the intermediate wall 44 of the housing. The slot portions of plate 108 are interrupted by two depressions 130 dimensioned to receive the roller 118 on the arm 116. A bracket 132 extends inwardly from the front wall 46, and a spring 134 has one end seated in this bracket and the other end seated within the bar 122. Accordingly, the bar 122 is normally urged downwardly whereby movement of the roller into either depression 130 will result in movement of the bar end beyond the position shown in FIGS. 2 and 3. A recess 136 is defined by the bar 122, and a spring-urged pin 138 is receivable within this recess when the roller 118 moves into the depressions 130. This arrangement serves as a safety interlock in the event that an attempt is made to rotate the handle 100 when the cash box is outside the housing or outside the acceptance receptacle to be described. Whenever such rotation occurs to the extent that the roller 118 falls into the recess 130, then the detent 138 locks the bar 122 thereby preventing any further rotation of the plate 110. This locks the shaft 101 against rotation thereby preventing opening of the door 62. It will be appreciated that when the cash box is properly used, the roller 118 remains in the area of the slot portions since the bottom of the bar 122 is restrained by the block 128.

The dotted line position of the plate 108 shown in FIG. 3 represents the starting position of the plate. When the cash box is inserted in a housing with a proper key, the plate is first rotated to the solid line position shown, by passing the first depression 130. This movement corresponds with the movement of the slot portions 89 and 90 relative to member 84 with the arm 82 and link 80 being stationary so that the door 62 remains closed. If this movement were attempted with the cash box outside the housing with the bar 122 unrestrained, the roller 118 would fall into a depression 130 thereby preventing movement of the plate to the solid line position of FIG. 3.

FIGS. 8*e*–8*g* illustrate a connection between the inspection plate 45 and the chute structure located in the fare box. Specifically, the chute 16 is formed from a pair of members including elongated section 51 and a short section 53. The section 53 includes an end portion 55 which is connected by means of a hinge 57. This end portion is normally maintained in contact with tabs 59 whereby fares or other valuables are adapted to pass through slot 61 and then downwardly toward the inspection plate.

The chute end portion 55 defines a plurality of teeth 63 and similar teeth 65 are formed at the end of chute section 51. As explained in the aforementioned Dominick, et al. patent, these teeth guard against "fishing", a pilfering technique wherein a wire or other elongated element is employed for engaging a piece of currency or other article in the cash box with the intention of pulling the article upwardly through the slot. The teeth 63 and 65 will strip such articles from the fishing tool.

The hinged connection for the end 55 of chute section 53 also guards against fishing. Specifically, an actuating rod 71 is pivotally supported on a bracket 73, and this rod carries a roller 75 adapted to engage the hinged end 55. A spring 77 normally holds the roller out of engagement with the hinged end; however, the arm 79 of the rod is engaged by actuating member 81 which is in turn actuated by the inspection plate 45. Thus, whenever the inspection plate is automatically or manually tilted, the member 81 (see FIG. 5*b*) will move the portion 55 to the horizontal position thereby effectively blocking direct passage of a fishing tool to the cash box interior.

As shown in FIGS. 2 and 3*a*, the rotatable member 84 which carries the arm 82 also supports a separately mounted lever arm 164. This arm defines an end portion 163 and an opposite end portion 165 which is attached to locking plate 166. The locking plate defines slots 166*a* which receive pins 48*b*, these pins being fixed to the plate 48*a*, secured on the back wall 48 of the cash box. A pin 164*b* is attached to the plate 166, and a slot 165*a* is formed in the end portion 165 of the arm for receiving the pin 164*b*. A second pin 164*a* is also mounted on the plate 48*a*, and this pin pivotally supports the arm 164.

Another pin 84*a* is mounted on the circular member 84, and this pin is received within the irregular cutout 163*a* defined by the upper end portion 163 of the arm. When the member 84 moves in a clockwise direction as described, the pin 84*a* operates to pivot the arm 164 with the extent of pivoting movement being controlled by the shape of the cutout 163*a*. This pivoting movement results in sliding of the locking plate 166 from left to right as shown in FIG. 3*a*.

The locking plate defines locking tabs 166*b* which are received within slots defined by keeper members 170 which are attached to the bottom wall 50 of the cash box. Upon sliding movement of the locking plate, the tabs 166*b* are separated from notches 168 defined by the keepers. It will, therefore, be apparent that movement of the member 84 results in release of the door 50 whereby the door is free to open. This is avoided, however, since positioning of the cash box within the housing automatically provides support for the bottom wall.

The support for the bottom wall 50 is provided by means of opposed blocks 171 secured to the bottom wall, and corresponding blocks 173 secured to the intermediate wall 44. The blocks 173 also serve as a guide track during movement of the cash box into the housing.

FIGS. 9 through 14 illustrate the acceptance receptacle construction 182 utilized for receiving valuables from the box 22. The drawings illustrate the portion of the construction providing for receipt of the box 22 and for the movement of the box contents into the vault portion generally designated by the number 184. This vault portion may be provided with any standard security door so that its contents can be retrieved only by authorized personnel.

The acceptance receptacle includes a front wall 186, a rear wall 188, top wall 190 and side walls 192 and 194. The front wall defines an opening for passage of the box 22 into the interior of the acceptance receptacle. This opening is normally closed by a door 196 hinged to the front wall at 198.

The door 196 carries a handle 200 which is secured to member 202, this member being mounted for rotation relative to the door on bearings 204 and 206. The latter bearings are located within a race 208 formed in the outwardly extending portion 210 of the member 202. Upper and lower flanged supports 211 and 213 receive the rim 215 of the member 202 to hold this member in place.

The member 202 defines a channel 212 at its inner end, and this channel is dimensioned to receive the handle 100 of the box 22. Accordingly, rotation of the receptacle handle 200 will impart turning force to the handle 100.

The rear wall 188 of the receptacle carries a support 214 for a key adapted to be inserted within the lock mounted on the rear wall 48 of the box 22. This key corresponds with the key 94 so that proper location of the box within the receptacle will free lock cylinder 96 for rotation relative to the lock plug. The end of interlocking rod 122 is engaged with a block corresponding with block 128, and the roller 118 on this rod is thereby maintained out of the depression 130.

The member 202 carries an outwardly extending section 218 defining a cam slot 220. This slot receives pin 222 which is secured to link bar 224. A rod 226 is attached at 225 to the end of the bar 224, and this rod reciprocates in response to movement of the pin 222 in the cam slot 220. Thus, as the handle 200 is rotated clockwise from the position shown in FIGS. 10 and 13, the pin 222 and bar 224 are driven downwardly which results in downward movement of the rod 226.

Guide members 228 are attached to the door 196, and these guide members maintain the rod in alignment. The lower end of the rod defines a groove 230 and a rod extension 232 defines a corresponding groove 234. This rod extension is secured in an axially fixed position to the wall 186 by means of guides 236. Accordingly, the extension 232 remains in position while the rod 226 swings with the door 196, and the groove arrangement 230 and 234, therefore, provides for interlock of the rod and rod extension only when the door is closed.

The door 196 also carries a curved arm 238 defining a slot 240. This slot includes an enlarged end portion 242 which exceeds the diameter of the rod and rod extension. The slot 240 is narrower than this diameter but is dimensioned to receive the undercut portion 244 of the rod extension. This arrangement prevents any vertical movement of the rod extension when the door is open so that the operation of the means for discharging valuables can only be accomplished with the door 196 blocking access to the interior of the receptacle.

The rod extension 232 carries a rack member 246, and the teeth of this rack engage pinion gear 248. The gear 248 is mounted on shaft 250 which is journalled at one end in the side wall 192 and at the other end in vertically extending intermediate wall 252.

The shaft 250 also carries a larger diameter gear 254 which meshes with gear 256. This gear is mounted on shaft 258 which is supported by intermediate wall 252. Accordingly, rotation of gear 248 by means of rack 246 drives gear 254 which, in turn drives gear 256. A supporting pan 264 is connected in the receptacle housing by means of a hinge 265 to a horizontally extending brace 267. This brace extends between the walls 194 and 252.

It will be noted that a right angle arm 233 is attached to the shaft 258 for pivoting movement as the gear 256 rotates. This arm supports a roller 235 which, in turn, engages the underside of pan 264 thereby providing a support for the pan. Since this support moves with the gear 256, the pan is free to open at the proper time.

The pan 264 also engages the outwardly extending portion 237 of a horizontally extending rod 239 which is supported by brackets 241 connected to the back wall 188 of the housing. A right angle extension 243 of the rod is connected to arm 245 which is tied to the shaft 250. The end of the arm 243 is received in a slot 247, and rotation of the shaft 250 operates to pivot the arm 245 downwardly thereby moving the portion 237 of the rod out of engagement with the underside of pan 264 thereby freeing the pan for opening thereof.

The blocks 171 of bottom door 50 of the box 22 will rest on the pan 264 when the box is positioned within the receptacle. As previously noted, the bottom door is hinged to the box at 172 and is maintained in the closed position by means of the interlocking plate 166 and keepers 170. Accordingly, the bottom door 50 is free to pivot downwardly with the support pan 264 when the plate 166 is moved out of interlocking position upon rotation of box handle 100. This rotation occurs simultaneously with rotation of receptacle handle 200 whereby the action of rack 246 pivots the support pan. When the bottom door opens, the contents of the box will, of course, fall into the receptacle area beneath the pan 264.

As illustrated in FIGS. 10 and 14, a gear 276 meshes with gear 254 for rotation in a direction opposite the gear 254. An arm 272 is supported on the shaft 273 which carries gear 276. A rod 300 defines a right angle bend whereby end portion 299 thereof can be positioned to engage the end of arm 272. The rod is therefor raised as the gear 276 is rotated in a clockwise direction. The brace 267 which supports the pan 264 defines an opening 302 which normally receives the upper end of the rod 300. When this rod is raised through the action of gear 276, the rod passes upwardly into the opening 304 defined by the member 301 which is attached to the door 196. Accordingly, the rod 300 serves to lock the door 196 so that the door cannot be opened once the handle 200 is rotated to lower the pan 264. The door can only be opened after the handle 200 is rotated back at which time the pan 264 will be locked in the closed position.

The construction described provides a highly secure and efficient arrangement for the collection and handling of deposits of valuables. The cash box design provides maximum space for acceptance of deposits while providing highly convenient means for operation of the security features thereof. The cash box is, in addition, completely adaptable to the acceptance receptacle described whereby a greatly improved combination of structures is achieved.

It will be understood that various changes and modifications may be made in the constructions described which provide the characteristics of the invention without departing from the spirit thereof particularly as defined in the following claims.

That which is claimed is:

1. In a construction for receiving valuables including a housing having a deposit section, a box for holding valuables deposited, a recess in said housing for removably receiving said box, an opening defined by said box for passage of valuables from said deposit section into said box, means normally blocking said opening, and a lock for holding said blocking means in the blocking position, said recess including means for unlocking said lock whereby said blocking means can be moved to unblocking position when the box is within said recess, the improvement wherein said blocking means comprises a door, a track receiving said door, said track serving to guide said door for sliding movement of the door on the track, a pivotally mounted arm connected to said door, means connecting said arm to said lock whereby the arm is free for movement only upon unlocking of the lock, and a handle mounted on the outside of said box and connected to said arm, rotation of the handle pivoting said arm to thereby slide said door along said track to an unblocking position.

2. A construction in accordance with claim 1 including a link connected to and extending between one end of said arm and said door, movement of said arm being transmitted through said link to said door.

3. A construction in accordance with claim 1 including a separate lock carried by said housing, said lock including a bolt engageable with said box, operation of the separate lock being required for removal of the box from the housing, said housing including means for discharging the valuables into the box, and means connecting said separate lock to said discharge means whereby discharge is required before removal of the box from the housing.

4. A construction in accordance with claim 3 wherein said discharge means comprises a pivoting dump plate, said separate lock operating a reciprocating rod for pivoting said dump plate.

5. In a construction for receiving valuables including a housing having a deposit section, a box for holding valuables deposited, a recess in said housing for removably receiving said box, an opening defined by said box for passage of valuables from said deposit section into said box, means normally blocking said opening, and a lock for holding said blocking means in the blocking position, said recess including means for unlocking said lock whereby said blocking means can be moved to unblocking position when the box is within said recess, the improvement wherein said blocking means comprises a door, a pivotally mounted arm connected to said door, means connecting said arm to said lock whereby the arm is free for movement only upon unlocking of the lock, and a handle mounted on the outside of said box and connected to said arm, rotation of the handle pivoting said arm to thereby move said door to unblocking position, and including a plate connected to said handle and movable therewith, a slot defined by said plate, a locking bar mounted in said box and having one end associated with said slot, and a depression defined by said slot for selectively receiving said one end of said locking bar whereby the locking bar retains said plate against movement.

6. In a construction for receiving valuables including a housing having a deposit section, a box for holding valuables deposited, a recess in said housing for removably receiving said box, an opening defined by said box for passage of valuables from said deposit section into said box, means normally blocking said opening, and a lock for holding said blocking means in the blocking position, said recess including means for unlocking said lock whereby said blocking means can be moved to unblocking position when the box is within said recess, the improvement wherein said blocking means comprises a door, a pivotally mounted arm connected to said door, means connecting said arm to said lock whereby the arm is free for movement only upon unlocking of the lock, and a handle mounted on the outside of said box and connected to said arm, rotation of the handle pivoting said arm to thereby move said door to unblocking position, said lock including a rotatable lock plug and a barrel, said arm being connected to the lock barrel whereby the arm pivots as the barrel moves around the plug, said plug being maintained in a stationary position by the means located in said recesses for unlocking said lock, and including means associated with said lock plug for engagement with said arm to prevent relative movement of the arm and lock plug in the event that an attempt is made to rotate the lock plug within the barrel.

7. In a construction for receiving valuables including a housing having a deposit section, a box for holding valuables deposited, a recess in said housing for removably receiving said box, an opening defined by said box for passage of valuables from said deposit section into said box, means normally blocking said opening, and a lock for holding said blocking means in the blocking position, said recess including means for unlocking said lock whereby said blocking means can be moved to unblocking position when the box is within said recess, the improvement wherein said blocking means comprises a door, a pivotally mounted arm connected to said door, means connecting said arm to said lock whereby the arm is free for movement only upon unlocking of the lock, and a handle mounted on the outside of said box and connected to said arm, rotation of the handle pivoting said arm to thereby move said door to unblocking position, and including an interlocking arm mounted for movement with said pivotally mounted arm, a separate door incorporated in said box providing an exit door for the passage of valuables out of the box, and means associated with said interlocking arm holding said separate door closed when the box is outside of said recess, movement of said interlocking arm with said pivotally mounted arm serving to shift the means associated with the interlocking arm to a position for releasing said separate door to permit passage of valuables out of the box.

8. In a construction for receiving valuables including a housing having a deposit section, a box associated with the housing for holding valuables deposited, said deposit section defining an opening for the insertion of said valuables and said box defining an opening for the passage of valuables from the deposit section into the box, and a pivoting dump plate interposed between said deposit section and said box, said dump plate retaining at least temporarily valuables deposited, and means for pivoting said plate for passage of said valuables into said box, the improvement comprising a chute structure in said deposit section for directing valuables deposited onto said dump plate, said chute structure including a short section adjacent the deposit section opening, a pivoting end portion connected to said short section whereby said end portion is adapted to be moved into a blocking position relative to said deposit section opening, and means operatively connecting said dump plate to said end portion whereby pivoting of said dump plate operates to move said end portion into said blocking position.

9. A construction in accordance with claim 5 including detent means for engaging said bar end for thereby retaining said bar in fixed position, said detent means engaging said bar when said one end of said bar is received in said depression, and wherein said detent means is inaccessible for disengagement with said bar without dismantling of said box.

10. A construction in accordance with claim 5 including means associated with said housing for engagement with said locking bar upon placement of said box in said housing whereby said bar is maintained out of engagement with said detent means when said box is in place for receipt of valuables.

11. A construction in accordance with claim 1 wherein said door comprises a rigid plate located at the top of the box, said track permitting horizontal sliding movement of the door whereby said door moves from a closed position to an open position at the top of the box.

* * * * *